United States Patent [19]

Cosmo

[11] Patent Number: 4,945,707

[45] Date of Patent: Aug. 7, 1990

[54] MACHINE AND METHOD FOR OVERWRAPPING CYLINDRICAL ARTICLES

[75] Inventor: Guy Cosmo, Selden, N.Y.

[73] Assignee: K. C. Technical Servies, Inc., Bohemia, N.Y.

[21] Appl. No.: 342,110

[22] Filed: Apr. 24, 1989

[51] Int. Cl.[5] ..... B65B 53/02; B65B 11/10; B65B 11/56

[52] U.S. Cl. ..... 53/399; 53/442; 53/64; 53/216; 53/557; 53/587

[58] Field of Search ..... 53/55, 442, 64, 214, 53/216, 557, 465, 399, 587

[56] References Cited

U.S. PATENT DOCUMENTS

| | | | |
|---|---|---|---|
| 2,938,319 | 5/1960 | Nystrand | 53/214 |
| 3,659,394 | 5/1972 | Hartleib et al. | 53/214 X |
| 3,897,671 | 8/1975 | Higgins | 53/557 X |
| 4,262,474 | 4/1981 | Reuter et al. | 53/389 X |
| 4,385,479 | 5/1983 | Focke | 53/389 |
| 4,467,589 | 8/1984 | Van Maanen | 53/389 X |
| 4,506,488 | 3/1985 | Matt et al. | 53/55 |
| 4,608,807 | 9/1986 | Skripalle | 53/214 X |

*Primary Examiner*—Horace M. Culver

*Attorney, Agent, or Firm*—Collard, Roe & Galgano

[57] ABSTRACT

A machine for wrapping generally cylindrical articles includes a web supply reel, an endless conveyor composed of a multiplicity of spaced-apart rollers for moving the articles along a predetermined path, a device for guiding and feeding the web on to the rollers, a device for feeding articles on to the web at a location at which it has already been guided on to the rollers, and transverse cutters for severing a predetermined portion of the web after an article has been placed thereon. An abutment is mounted along the predetermined path and disposed to tangentially engage the rollers to cause their rotation which, in turn, causes rotation of the articles thereby wrapping a predetermined portion of the web around themselves. The machine also includes an integral heat tunnel and an electronically-controlled drive for accelerating and decelerating the conveyor in timed relation with respect to the movement of the web. A method for wrapping cylindrical articles is also disclosed.

12 Claims, 4 Drawing Sheets

MACHINE AND METHOD FOR OVERWRAPPING CYLINDRICAL ARTICLES

BACKGROUND OF THE INVENTION

1. Field of the Invention

The invention relates to a machine and method for overwrapping cylindrical or nearly cylindrical articles for packaging or labeling of those articles. More particularly, the invention relates to a machine and method for shrink-wrapping individual rolls of adhesive tape rolls.

2. Description of the Prior Art

Machines are known for wrapping articles and, in particular, cylindrical or nearly cylindrical articles. One such commercial machine is disclosed in U.S. Pat. No. 3,659,394. The machine is specifically designed and used for packaging and labeling articles, such as adhesive tape rolls. These adhesive tape rolls vary in size, but they typically are manufactured in widths of between ¼ inch up to 2 to 3 inches.

The rolls are individually wrapped in a two-step process. In the first stage, a wrapping machine, such as that disclosed in the above patent, is used to individually wrap the adhesive tape rolls. This is accomplished by feeding the sheet of wrapping material (e.g., a shrink wrappable material such as PVC film) in the form of a web from a supply reel, applying an adhesive to the leading edge thereof, setting the roll on the leading edge of the web, and then causing the roll to rotate in engagement with the sheet material to thereby entrain the material, thus automatically wrapping the same around its own external periphery. This operation is normally accomplished with a row of spaced-apart rolls being fed and wrapped simultaneously as they move along a conveyor.

In the second step, the successive rows of the individually-wrapped rolls are then discharged from the machine and transferred to a second conveyor of a heating tunnel wherein the rolls are fed into an oven and subjected to heat to cause the sheet material to shrink-wrap around the peripheral edge of the cylindrical rolls of tape. The articles are then discharged from the heating oven for packaging and shipment to the customer.

One of the problems with this commercial technique is that the speed of the unit is limited due to the employment of a clutch brake system for actuation of the conveyor which transports the cylindrical rolls of tape. Due to the abrupt start and stop movement of a conveyor with such a mechanism, the cylindrical rolls of tape which are free standing on the conveyor are often jossled, causing toppling of the rolls. This, in turn, requires that the machine be stopped or slowed down to remove the fallen rolls of tape. Another problem caused by this two-step process is that one must use adhesive or glue to temporarily adhere the leading and trailing edges of the film and prevent the unwrapping of the rolls when moved from the conveyor of the wrapping unit to the conveyor of the heat tunnel. The machines, as well, are relatively bulky and complicated in design, often requiring long shut-downs periods due to cumbersome and time-consuming repair and maintenance requirements.

SUMMARY OF THE INVENTION

Accordingly, it is an object of the present invention to provide an improved machine for overwrapping cylindrical and nearly cylindrical articles, whether as individual articles per package or as multiple articles per package, or whether individual packages per machine cycle or multiple packages per machine cycle.

It is also an object of the present invention to provide such a machine which is relatively simple in design, has a high degree of reliability and flexibility and provides significantly higher speeds of operation.

It is a more particular object of the present invention to eliminate the need for the use of glue for causing the sheet material to adhere to the cylindrical objects and to eliminate the need to use pre-slit rolls of wrapping material.

It is a further object of the present invention to provide a machine having the foregoing attributes and characteristics which provide for a smooth acceleration and deceleration of the conveyor to minimize jossling of the articles to be packaged.

Certain of the foregoing and related objects are readily attained in a machine for wrapping generally cylindrical articles enbodying the present invention which includes a supply reel rotatably mounted in the machine for unreeling a web of sheet material, an endless transport means including a multiplicity of spaced-apart rollers operatively mounted thereon for moving the articles along a predetermined path, means for guiding and feeding the web on to said rollers of the endless transport means operatively connected to said supply reel, and means for feeding articles at predetermined intervals on to said web at a location at which it has already been guided on to said transport means, the movement of such feeding being synchronized to the movement of the transport means. The machine also includes transverse cutting means operatively coacting with the transport means for severing a predetermined portion of the web after an article has been placed thereon, and abutment means operatively mounted along the predetermined path disposed to tangentially engage the rollers of the transport means causing their rotation which, in turn, causes rotation of the articles in a direction opposite the movement of the transport means, thereby wrapping a predetermined portion of the web around themselves. The machines especially include means for exposing the wrapped articles to heat for the purpose of hot sealing, shrinking or drying the sheet material and securely wrapping it about the articles, disposed along a portion of the endless transport means, and electronically-controlled drive means for accelerating and decelerating the transport means in timed relation with respect to the movement of said web and the feeding of the articles.

Preferably the machine additionally including spray means for applying a liquid spray (especially water) to the web. In addition, the means for exposing advantageously comprises a heat tunnel having a generally inverted U-shaped housing which defines a tunnel extending along a portion of the predetermined path, means for heating the air in the tunnel and means for circulating heated air through the tunnel. Most desirably, the housing is double-walled so as to define an outer shell and inner shell and an air gap therebetween.

In a particularly preferred embodiment of the invention, the electronically-controlled drive means comprises an electric stepping motor operatively coupled to the transport conveyor and an electronic motor controller coupled to the stepping motor for controlling the speed of operation and the acceleration and deceleration of the stepping motor. Most advantageously, the electronically-controlled drive means includes a programmable electronic sequence controller for electronically sequencing the transport conveyor drive means in timed sequence to the means for feeding the web and the articles.

In a further embodiment of the invention, the machine additionally including means for longitudinally slitting the web of sheet material prior to the feeding of the web on to the rollers. This is preferably accomplished by a plurality of spaced-apart razor blade slitters.

Certain of the foregoing and related objects are also attained in a method of wrapping a generally cylindrical article to package or label same of the type comprising the steps of withdrawing the sheet material from a web, feeding and guiding the web on to an endless transport conveyor, feeding articles on to the web at predetermined intervals, spraying portions of said web with a liquid to permit temporary adhesion of the web to an article to be wrapped, transversely cutting the web after the article has been placed thereon, setting the article into rotation while it engages the sheet material so that the article entrains the sheet material and wraps it around its external periphery, and while it in said engagement, imparting a translational movement to said article along a predetermined path directed transversely of the axis of the rotation of the article, and heating the wrapped article to cause the article to be securely wrapped by the sheet material. The invention provides for heating the wrapped article while the article is transported along the transport conveyor. Preferably, water is used as the liquid in the spraying step. Furthermore, the method preferably includes the step of electronically controlling the acceleration and deceleration of the conveyor.

Other objects and features of the present invention will become apparent from the following detailed description considered in connection with the accompanying drawings. It is to be understood, however, that the drawings are to be used for the purpose of illustration only, and not as a definition of the limits of the invention.

BRIEF DESCRIPTION OF THE DRAWINGS

Further advantages and details can be gleaned from the drawings wherein similar reference numerals denote similar elements throughout the several views. In the drawings.

DETAILED DESCRIPTION OF THE PREFERRED EMBODIMENTS

Figure 1:
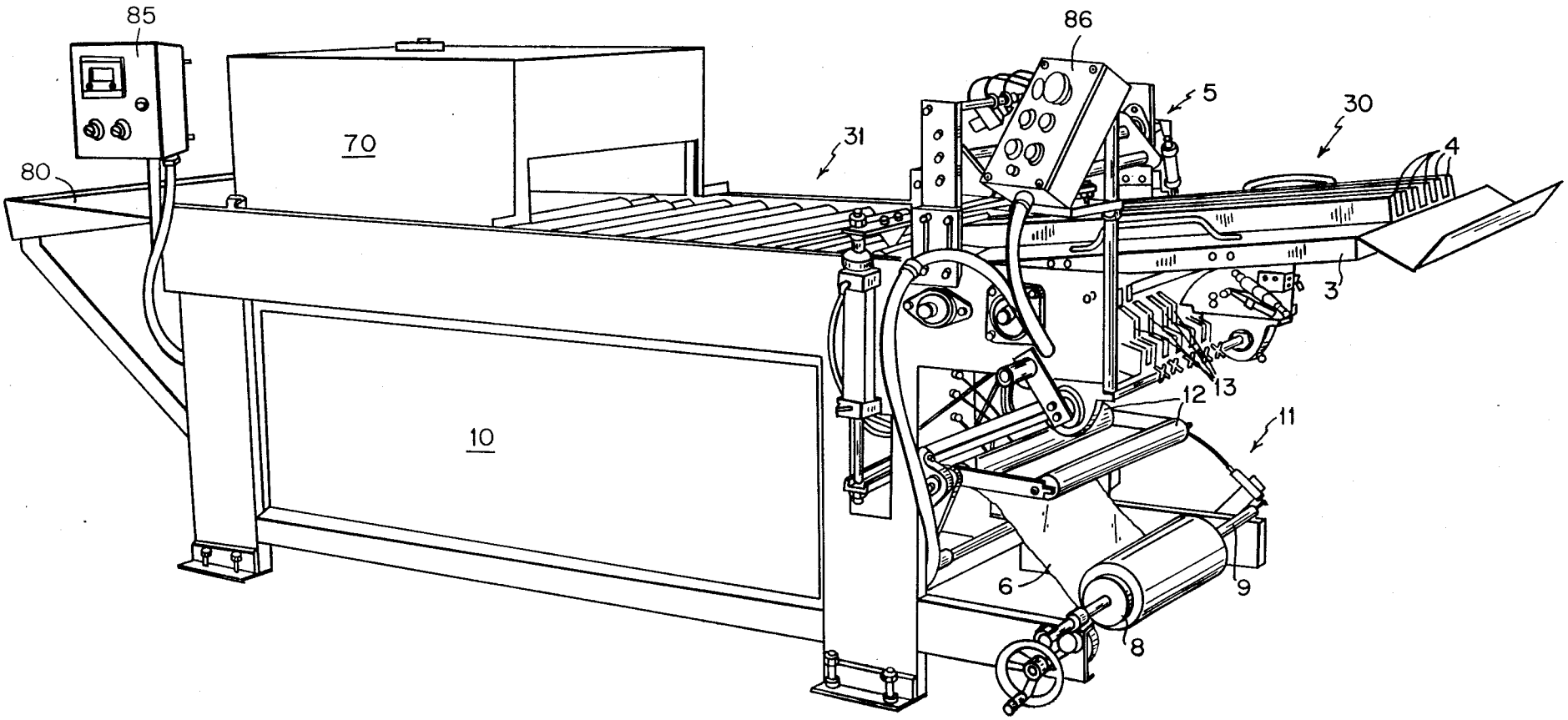
FIG. 1 is a perspective top, side and end view of a novel machine embodying the present invention.
Figure 2:
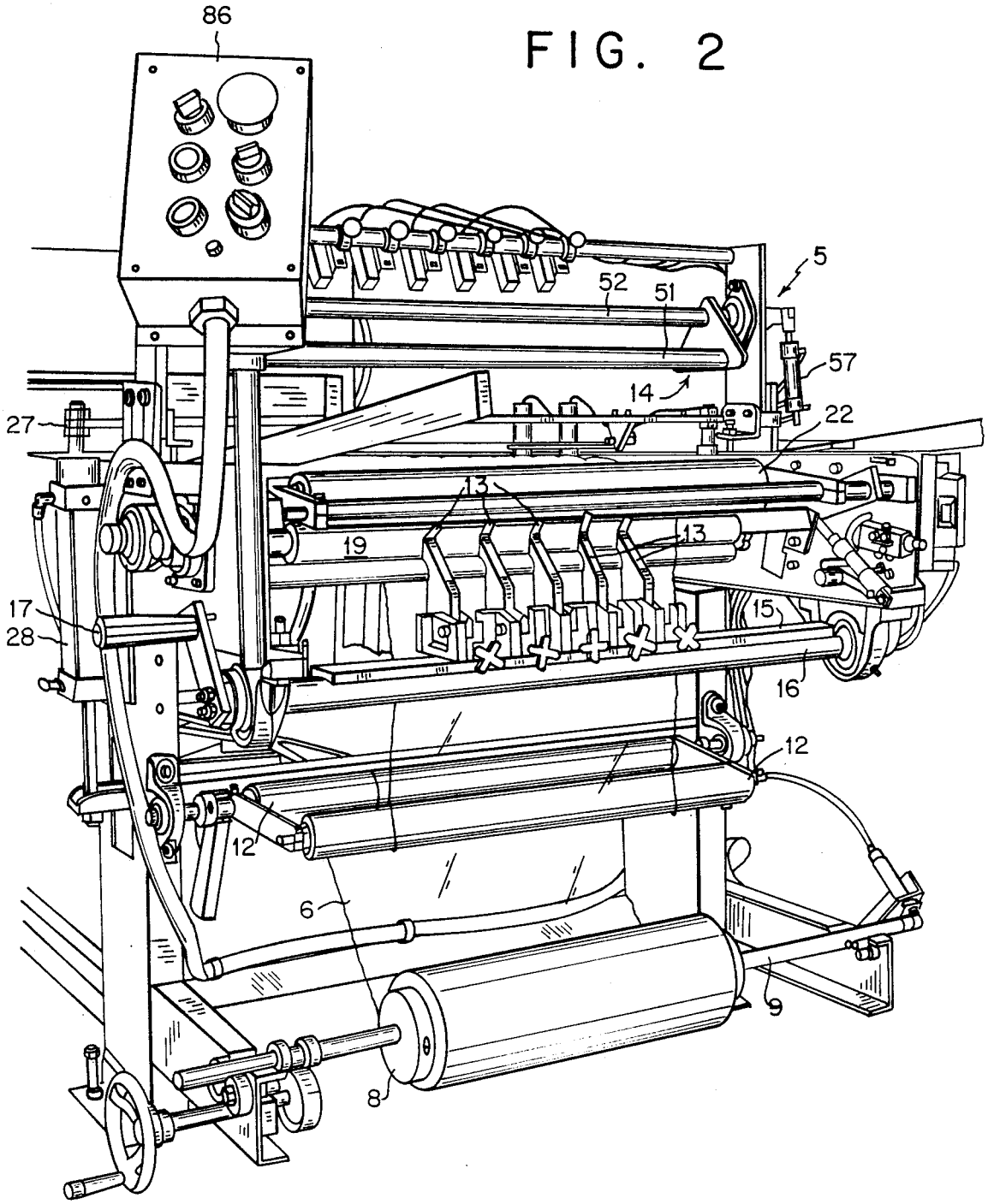
FIG. 2 is a perspective end view thereof, with the article infeed assembly removed.

Referring now in detail to the drawings, and, in particular, FIG. 1, therein illustrated is a novel wrapping machine especially intended for wrapping cylindrical articles which includes a machine base or table 10, which supports a web feeding assembly 11, an article infeed assembly 30, and an indexing article transport conveyor assembly 31, and a heat tunnel 70. The basic construction and operation of the machine is perhaps best illustrated in the schematic drawing of FIG. 3. As can be seen therein, the web feeding assembly includes an overwrap material mill roll 8 supported on a shaft 9, the free rotation of which is controlled by a mill roll brake consisting of a brake disk 110 and brake caliper 111. The web 6 of overwrap material wound on mill roll 8, typically consists of a shrinkwrappable film, such as PVC, polyethylene or polyolefin. However, other materials, such as paper, could also be used. Web 6 is fed from the mill roll over guide rollers 12. Web 6 is then guided past a multiplicity of slitting blades 13 which serve to longitudinally slit the web according to the number of articles to be wrapped simultaneously. Slitting blades 13 are demountably secured to a mounting bar 15 supported on a shaft 16 which, in turn, is connected to a throw-off handle 17. This permits the slitting blades 13 to be pivoted into and out of engagement with the web, as desired, such as for replacing blades, adding additional blade subassemblies, etc. As can be seen best in FIG. 2, there are five slitters 13 provided which thereby produce six web panels for, in turn, wrapping six articles at a time. This, of course, can be varied, depending upon the particular application and desire of the operator.

Web 6 is then fed between the overwrap material feed roller 18 and overwrap material pressure roller 22. Feed roller 18 is mounted on feed roller shaft 20 which, in turn, is controlled by feed roller brake 21 and brake/-clutch drive 44, as described in greater detail hereinafter.

The web 6 is then fed along the overwrap material feed skid plate 25, which is disposed to guide the web 6 on to the inlet end of the endless transport conveyor assembly 31 consisting of a pair of spaced-apart chain sprocket wheels 33, 33' on which are mounted chain driven, independently and freely rotatable, spaced-apart conveyor rollers 36. Sprocket wheel 33 is mounted on sprocket shaft 34 for rotation therewith which, in turn, is coupled to sprocket shaft clutch 35. Clutch 35 is operatively coupled via a belt to a feed roller brake 21 coupled to feed roller shaft 20. This conventional brake/-clutch drive 44 composed of clutch 35 and brake 21 serves to permit timed feeding of the web in relation to the indexing of the conveyor. A suitable brake/clutch drive is sold by Warner Electric Brake and Clutch Company of South Beloit, Ill. (EB475 per Drawing I 256927 SF400 per Drawing I 25696. Sprocket sheel 33' is coupled via a belt to stepping motor 39 which, in turn, is controlled by an electronic motor controller 40. The electronic motor controller 41 controls the speed of the stepping motor 39, allowing it to accelerate at a set rate, to the predetermined running speed. Similarly, it controls the rate of deceleration according to the set rate until the base speed (0) is reached. This rate is set to allow an extremely smooth starting and stopping of the motor drive and, in turn, the conveyor. A suitable electronic motor controller (Packaged Translator/ Oscillator 3180-PTO) and a drive or stepping motor (Slo-Syn Stepping Motor M112FJ8012) is sold by Superior Electric of Bristol Conn.

The article infeed station 30 has a removable infeed table or base 3, having a series of lane dividers 4, so as to allow a row of articles to be fed in accordance with the number of rows defined by the number of slitters 33 employed. The infeed table 3 has a conventional pneumatically-operated pivotal article escapement device 5 associated therewith for successively feeding the articles in timed relation to the feeding of the web 6. As a result, after the web 6 is deposited upon two adjacent rollers 36, the article would then also be fed on to the same adjacent rollers 36. As can be seen best in FIG. 2, article escapement device 5 includes an infeed gate assembly 14 comprised of a pivotably supported pivot shaft 52 and two gate arms 51. Pivot shaft 52 is operated by pneumatic cylinder 57.

Figure 3:
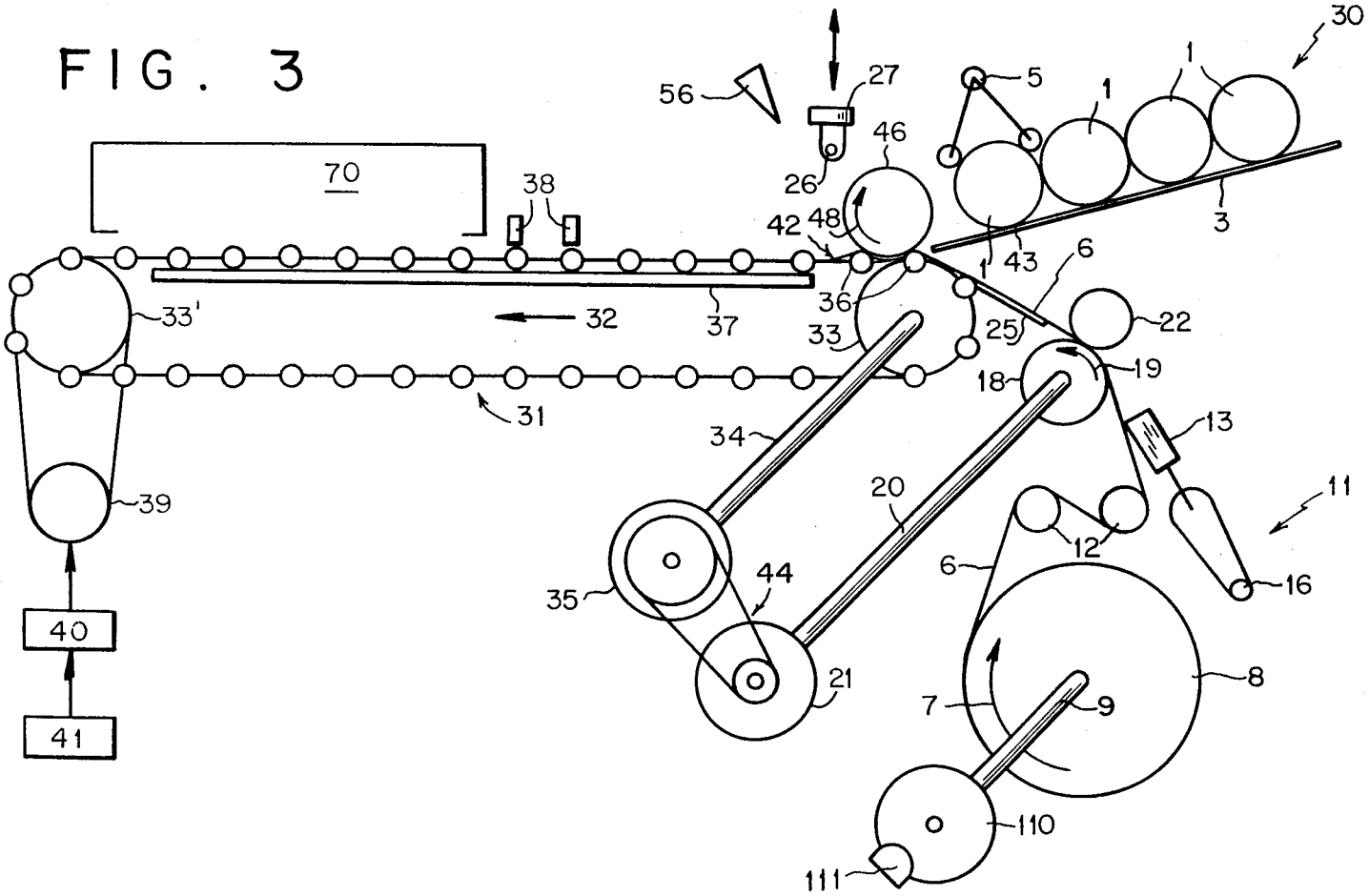
FIG. 3 is a schematic side-elevational view of the machine.

As shown in FIGS. 1 and 3, disposed adjacent to the article infeed assembly 11 is a transversely disposed parting wire 26 supported by a parting wire carriage 27. Carriage 27 is supported and activated via pneumatic cylinder 28 for effecting reciprocal vertical movement of wire 26 in the direction of arrow 28 for cutting the web into discrete portions. Following the parting wire 26, a series of atomizing nozzles 56 (FIG. 3) are provided for wetting the web, preferably with distilled water.

The various movements of the machine are controlled in timed sequence (as described hereinafter) by a conventional programmable electronic sequence controller 41. A suitable controller is the EPTAK 100 programmable controller sold by Eagle Signal Controls of Austin, Tex. A control panel 86 is provided (FIG. 1) for operating the machine (e.g., start, stop, etc.).

Figure 5:
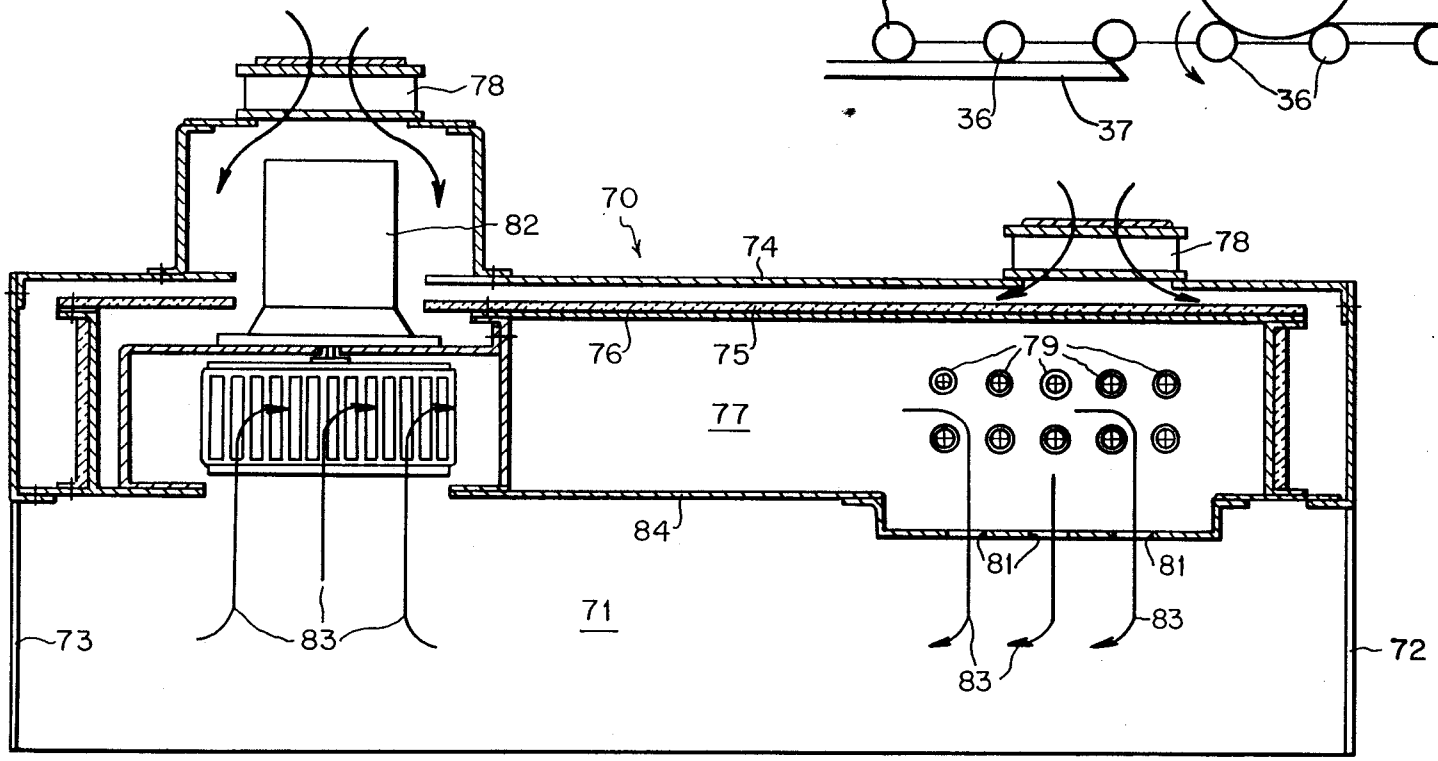
FIG. 5 is a longitudinal-sectional view of the integral heat tunnel.

FIG. 5 illustrates the construction of the heating tunnel 70 which is mounted on the machine table 10 above the discharge end of the transport conveyor 31. Heating tunnel 70 has a longitudinal passageway 71 having an inlet end 72 and a discharge end 73. As seen best in FIG. 3, the upper run of the roller conveyor 31 which serves to transport the wrapped articles passes through tunnel 71. Heating tunnel 70 is double-walled, having an outer shell 74 separated by an air space and a layer of insulation 75 from a plenum shell 76 of a hot air plenum 77. Two cooling fans 78 are used to cool the air space and, in turn, the outer shell 74 of the heating tunnel, so as to prevent possible injury to operators of the machinery.

A series of electrical heating elements 79 are disposed in hot air plenum 77, adjacent to the entrance 72 of the hot air chamber 71. The tunnel inner shell 84 has a baffle with a plurality of apertures 81 disposed underneath the heating elements 79 to allow the heated air to be directed towards the wrapped articles (not shown). This is assisted by a high temperature blower 82, the motor housing of which is mounted in the outer air gap, and the fan of which communicates with the hot air chamber 71 and the hot air plenum 77 to effect circulation of the hot air in the direction of the arrows 83. Although not shown, it is also possible to have openings 81 in the side walls of the heating tunnel 70 so as to direct heated air to the sides of the articles, if desired. A control panel 85 (FIG. 1) is provided for operating the heating tunnel (e.g., start, stop, temperature control, etc.).

Turning now to the operation of the machine, a machine cycle begins with overwrap material 6 having been drawn in the form of a web 6 from the overwrap material mill roll 8 in the direction indicated by arrow 7. Web 6 is then guided around overwrap material guide rollers 12, and past overwrap material slitting blades 13 to effect longitudinal slitting of the web into the desired number of "sub" webs for simultaneously and individually wrapping a similar number of articles 1. The slit web 6 is then fed between the overwrap material feed roller 18 and overwrap material pressure roller 22 and along the overwrap material feed skid plate 25. The web 6 is then fed on to an adjacent pair of article support rollers 36 having been brought into and held in an appropriate position by the indexing transport conveyor motor 39 operating according to instructions previously programmed into the electronic motor controller 40 and being monitored by the programmable electronic sequence controller 41.

To prepare for continuous and automatic machine operation, excess overwrap material is initially parted from the web 6 by the material parting wire 26. Wire 26 is held perpendicular to the direction of travel 32 (FIG. 3) of the indexing transport conveyor 31, by the material parting wire carriage 27 and brought into contact with the overwrap material 6 by the overwrap material parting wire carriage actuators 28 secured to the near and far ends of the parting wire carriage 27 acting in the direction indicated by the arrow 8 (FIG. 3).

The overwrap material parting wire 26 and parting wire carriage 27 are engaged and withdrawn to their appropriate positions and in an appropriate sequence according to instructions programmed into the programmable electronic sequence controller 41. Upon withdrawal of the overwrap material parting wire 26 and parting wire carriage 27, water is atomized through nozzles 56 (FIG. 3) suspended above the indexing transport conveyor 31 and forward, in the direction of travel 32 of the indexing transport conveyor 31, of the parting wire carriage 27 across the width of the overwrap material 6 at a point directly behind, in the direction of travel 32 of the indexing transport conveyor 31, the point 42 at which the overwrap material 6 has been parted from the web 6 by the action of the overwrap material parting wire 26.

At this point, an appropriate amount of overwrap material 6 rests on an adjacent pair of article support rollers 36, with the indexing transport conveyor 31 in the dwell portion of its cycle. The overwrap material parting wire 26 and parting wire carriage 27 having been withdrawn to an appropriate position by the parting wire carriage actuators 28 (FIGS. 1 and 2) operating according to instructions previously programmed into the programmable electronic sequence controller 41. Water has been atomized through nozzles 56 suspended above the indexing transport conveyor 31 to coat the width of the overwrap material 6 at a point directly behind, in the direction of travel 32 of the indexing transport conveyor 31, the point 42 at which the overwrap material 6 has been parted from the web by the action of the overwrap material parting wire 26. Then, an article 1, being held by the escapement mechanism 5 which is suspended above the article infeed lane dividers 4 (see FIG. 1) is deposited, by the action of the escapement mechanism 5 according to instructions previously programmed into the programmable electronic sequence controller 41, on to the adjacent pair of article support rollers 36 carrying the overwrap material 6 and holds the overwrap material 6 between the article 1 and the adjacent pair of article support rollers 36.

With an article 1 on the adjacent article support rollers 36 and the overwrap material held between the article 1 and the adjacent article support rollers 36, the indexing transport conveyor 31 accelerates to its nominal running speed by consequence of the action of the transport conveyor motor 39 according to instructions previously programmed into the electronic motor controller 40 and being constantly monitored by the programmable electronic sequence controller 41. Overwrap material 6 is fed simultaneously, and at a rate consistent with the rate of advance of the indexing transport conveyor 31, thus maintaining the relationship previously established between the article 1, the overwrap material 6, and the adjacent article support rollers 36. A chain or belt drive 44 couples the indexing transport conveyor sprocket shaft 34 to the overwrap feed roller shaft 20 and overwrap material feed roller 18 the configuration of which assures the simultaneity of the complementary actions.

Figure 4:
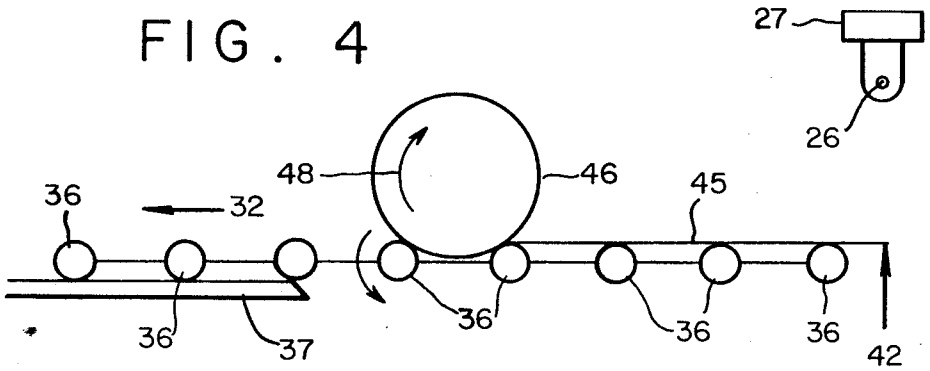
FIG. 4 is a fragmentarilly-illustrated schematic view of the machine showing the step of adhering the leading edge to the cylindrical object.

The indexing transport conveyor advance and overwrap material feed continue, monitored by the programmable electronic sequence controller 41 through the transport conveyor rollers sensors 38 (FIG. 3) until an appropriate length of overwrap material, determined by instructions previously programmed into the programmable electronic sequence controller, has passed the point 42. The indexing transport conveyor 31 now decelerates from its nominal run speed by consequence of the action of the transport conveyor motor 39 according to instructions programmed into the electronic motor controller 40. At a moment just prior to the moment at which the indexing transport conveyor 31 completes its deceleration and comes to rest, the material feed roller brake 21 is actuated causing the overwrap material 6 being carried by the adjacent article support rollers 36 to withdraw from its original position forward of the lead article support roller 36, to a position which places the leading edge of the overwrap material at a point where the article 1 and the lead support roller 36 are tangent (FIG. 4). The leading edge of the overwrap material having been previously coated with water atomized through nozzles 56 is now adhered to the article 1 by the compression of the article 1 against the adjacent pair of article support rollers 36.

The indexing transport conveyor 31 now comes to rest by consequence of the action of the transport conveyor motor 39 according to instructions programmed into the electronic motor controller 40. With the indexing transport conveyor 31 in the dwell portion of its cycle, the overwrap parting wire 26 and parting wire carriage 27 are engaged and withdrawn to their appropriate positions separating the previously metered length of overwrap material 45 from the web of overwrap material 6.

Subsequent articles are brought into the ready position in the escapement mechanism 5 by the action of gravity, the article infeed base 3 having been fixed, at an appropriate angle of declination, above the indexing transport conveyor 31. Continuous and automatic machine infeed operations proceed with individual motions occurring in proper sequence, as previously described, according to instructions previously programmed into the electronic motor controller 40 and the programmable electronic sequence controller 41.

With the subsequent infeed sequence now complete, the indexing transport conveyor 31 accelerates to its nominal running speed, the rate and uniformity of which (and similarly, the rate and uniformity of deceleration) is governed by the transport conveyor motor 39 and electronic motor controller 40. This assures the stability of articles-in-process 46, allows higher machine cycle rates, and eliminates interruption of continuous and automatic machine cycles caused by toppling articles associated with previously available indexing transport conveyors.

As the indexing transport conveyor accelerates to its nominal run speed the adjacent pair of article support rollers 36 now carrying the article-in-process 46 and the separated, metered length of overwrap material 45 are brought into contact with the support roller guide rails 37. The forward motion 32 of the indexing transport conveyor 31 in combination with the tangential contact of rollers 36 with rails 37 imparts rotation to the adjacent pair of article support rollers 36 in the direction indicated by the arrow 48 shown in FIG. 4. The resultant counter-rotation 48 of the article-in-process 46 draws the separated, metered length of overwrap material 45 around the circumference of the article-in-process 46, the leading edge of the separated, metered length of overwrap material having been adhered to the article-in-process 46 as previously described.

Continuous and automatic machine cycles proceed carrying the now overwrapped article-in-process along the length of the indexing transport conveyor 31. The counter-rotation 48 of the article-in-process continues as the article enters the integral heat tunnel 70. The circulating hot air in the heat tunnel heats the web causing it to be firmly adhered to the article. Subsequent machine cyles carry the completed, overwrapped or shrink-wrapped articles to the discharge end of the indexing transport conveyor 31 where an accumulation tray 80 or automatic collection assembly is positioned (FIG. 1).

The integral heat tunnel 70 is an improvement over previously available equipment in that it eliminates the transfer of articles-in-process to a secondary conveyor which, by action of the transfer, often topples articles, especially narrow or unstable cylindrical articles, causing interruption of continuous operation. Furthermore, this integral heat tunnel configuration eliminates the need for, and additional power consumption of, a pre-shrink section previously employed to keep the overwrap material from unwrapping during transfer In particular, these prior art machines have a set of oscillating heat guns mounted above the wrapping conveyor. After the packaging material is wrapped around the product but prior to being transferred on to the shrink tunnel conveyor, the heat guns oscillate down to direct hot air on to the wrapped products to provide a "pre-shrink". This pre-shrink causes the package material to draw in around the product sufficiently to allow it to be transferred without stripping the package film. This entire subassembly is eliminated in the present machine.

Moreover, because of the very direct air flow and extremely short travel distance of the heated air, this tunnel provides enough energy to shrink the packaging material in a very short period of time, allowing for a more compact unit. In addition, the physical design of the tunnel is such that a thermal barrier is created between the interior and exterior shells. By forcing ambient air through the thermal barrier, via cooling fans, the skin temperature of the outer casing stays at a much cooler level than prior art designs As previously noted, existing equipment utilizes a waterbased adhesive (e.g., wallpaper paste), to create the required adhesion between the product and the packaging material. This requires that the adhesive be mixed and stored in a pressurized tank to be fed to the spray valves. The adhesive by its very nature causes the spray valves to clog, necessitating periodic maintenance. Also, the overspray adhesive directed at the packaging material requires periodic cleaning of the infeed assembly, the conveyor rollers and all adjacent components. The present system, however, as a result of the use of the integrated shrink tunnel eliminates the need for a "strong" adhesive. Relatively weak adhesive obtained by wetting the web with filtered water is sufficient in the present machine. As a result, there is no mixing, no holding tank, no adhesive build-up and, therefore, no required periodic maintenance.

In contrast to existing equipment, wherein the film feeding and slitting section is covered by the product infeed tooling, the present design affords the advantage of an easily removable article infeed assembly which, when removed, provides complete access to the film feed slitting section.

Another advantage of the present invention is the elimination of the need for crush-cut slitters for severing the mill roll into individual strips for wrapping around the articles. A crush-cut slitter is a hardened rotating blade running at "zero clearance" against a hardened anvil. Both the slitter and the anvil must be extremely hard and precision ground. By their very nature, the slitter blades dull fairly quickly which requires either regrinding or replacement. In contrast thereto, the present invention utilizes a commercial razor blade which only contacts the sheet material. As a result, the service life of the razor blade is dramatically longer than the crush cut blade and its replacement cost is negligible in comparison. Also, in the course of production, as the crush cut slitter begins to dull, it will not severe the film completely. Therefore, when two adjacent products are wrapped and shrunk, they will shrink together, creating a rejected product. This, however, may not be readily apparent to the machine operator. In contrast, when a razor blade reaches the end of its service life, it will tear the film, as opposed to slitting it, which will become readily apparent to the operator.

Another disadvantage of the prior art machines is that the anvil for the crush cut slitters also serves as the film feed roll. Contacting this roller are individual pressure rolls, e.g., after the film has been slit, each strip has its own pressure roller. If there is a inconsistency in the winding of the film from side to side, it will now manifest itself at the feed roller. This will cause a sagging or a loss of tension in one or several of the strips between the mill roll and the feed roller. Without some level of tension in the film, it will neither track true or slit properly. When the condition reaches this point, it requires the operator to stop the machine and draw up the excess film in those lanes in order to produce a constant tension across the entire web. In contrast thereto, the present invention utilizes a single full width feed roller and pressure roller, as a result of which a variation in film winding will not manifest itself as a problem. In the prior art machine between the mill roll and the film feed roll, a set of festooning rollers are attached to a mechanical brake to maintain web tension. In the present invention, on the other hand, a pair of stationary idler rollers are positioned between the mill roll and the film feed roller and a pneumatic disc brake, controlled via the microprocessor, maintains web tension.

As previously noted, the existing machine utilizes an electro-mechanical clutch brake system for the indexing of the transport conveyor. Because of the shock load incurred during the start and stopping of each conveyor cycle, these components are subject to wear and require periodic replacement. The present invention, on the other hand, uses an electronic drive system which accelerates from 0 to a predetermined speed and decelerates back to 0 from each conveyoring index and is therefore not subject to the shock load and wear otherwise heretofore incurred. This also minimizes the possibility of toppling of the individual cylindrical articles.

The overall design of the present machine greatly improves the speed of operation. In fact, a test was conducted between the present invention and the machine of U.S. Pat. No. 3,659,394. The machines were employed to wrap ¾ inch wide tape for a period of eight hours. The prior art patented machine was able to produce 210 cases of ¾ inch tape, 48 wrapped tapes per case, with a rejection rate of 8%. In contrast, the present invention was able to produce 380 cases, with a rejection rate of only 1 to 2%.

As can be appreciated, various modifications may be made to the method and machine of the present invention, as will be apparent to those skilled in the art. For example, although the machine is specifically intended for wrapping adhesive tape rolls, other items such as wrapping paper, wallpaper, etc. could be used in the present machine. In addition, although the machine is specifically intended for use with shrink-wrap film, such as PVC, polyethylene or polyolefin, which typically come in thicknesses of ¾ mil to 1¼ mil, it would be possible to wrap articles with paper, if so desired, although it may be necessary to use glue in such a case.

Thus, while only one embodiment of the invention has been shown and described, it is obvious that there are many changes and modifications that may be made thereunto without departing from the spirit and scope of the invention.

What is claimed is:

1. A machine for wrapping generally cylindrical articles comprising:

a supply reel rotatably mounted in said machine for unreeling a web of sheet material;

an endless transport means including a multiplicity of spaced-apart rollers operatively mounted thereon for moving said articles along a predetermined path;

means for guiding and feeding said web on to said rollers of said endless transport means operatively connected to said supply reel;

means for feeding articles at predetermined intervals on to said web at a location at which it has already been guided on to said transport means, the movement of such feeding being synchronized to the movement of said transport means;

transverse cutting means operatively coacting with said transport means for severing a predetermined portion of said web after an article has been placed thereon;

abutment means operatively mounted along said predetermined path disposed to tangentially engage the rollers of said transport means causing their rotation which, in turn, causes rotation of said articles in a direction opposite the movement of said transport means, thereby wrapping a predetermined portion of said web around themselves, means for exposing the wrapped articles to heat for the purpose of hot sealing, shrinking or drying the sheet material and securely wrapping it about the articles, disposed along a portion of said endless transport means; and electronically-controlled drive means for accelerating and decelerating said transport means in timed relation with respect to the movement of said web and the feeding of said articles.

2. The machine according to claim 1, additionally including spray means for applying a liquid spray to said web.

3. The machine according to claim 1, wherein said means for exposing comprises a heat tunnel having a generally inverted U-shaped housing which defines a tunnel extending along a portion of said predetermined path, means for heating the air in said tunnel and means for circulating heated air through said tunnel.

4. The machine according to claim 3, wherein said housing is double-walled so as to define an outer shell and inner shell and an air gap therebetween.

5. The machine according to claim 1, wherein said electronically-controlled drive means comprises an electric stepping motor operatively coupled to said transport conveyor and an electronic motor controller coupled to said stepping motor for controlling the speed of operation and the acceleration and deceleration of the stepping motor.

6. The machine according to claim 1, wherein said electronically controlled drive means includes a programmable electronic sequence controller for electronically sequencing said drive means in timed sequence to said means for feeding said web and said articles.

7. The machine according to claim 1, additionally including means for longitudinally slitting said web of sheet material prior to the feeding of said web on to said rollers.

8. The machine according to claim 7, wherein said means for longitudinally slitting comprises a plurality of spread apart razor blade slitters.

9. The machine according to claim 1, wherein said web supply reel contains a single uncut roll of predetermined width and wherein means for guiding and feeding said web includes a single feed-roller and pressure roller, each having a width generally equivalent to said roll on said web supply reel.

10. The machine according to claim 9, wherein a pair of stationery rollers are positioned between the roll and the film feed rollers about which the web is guided and wherein a pneumatic disk brake is operatively coupled to the web supply reel to maintain web tension.

11. In a method of wrapping a generally cylindrical article to package or label same of the type comprising the steps of withdrawing sheet material from a web, setting the article into rotation while it engages the sheet material, so that the article entrains the sheet material and wraps it around its external periphery, and while it is in said engagement, imparting a translational movement to said article along a predetermined path directed transversely of the axis of the rotation of the article, and heating said wrapped article to cause said article to be securely wrapped by said sheet material, the improvement comprising:

heating said wrapped article while said article is transported along said transport conveyor; and electronically controlling the acceleration and deceleration of said conveyor in timed relation with respect to the movement of the web and the feeding of said articles.

12. The method according to claim 11, wherein water is used as said liquid in said spraying step.

* * * * *

UNITED STATES PATENT AND TRADEMARK OFFICE

CERTIFICATE OF CORRECTION

PATENT NO. : 4,945,707

DATED : August 7, 1990

INVENTOR(S) : Guy Cosmo

It is certified that error appears in the above-identified patent and that said Letters Patent are hereby corrected as shown below:

Cover page, column 1, item [73], delete line 1 in its entirety and substitute therefor —K.C. Technical Services, Inc.—.

Signed and Sealed this

Twenty-second Day of January, 1991

*Attest:*

HARRY F. MANBECK, JR.

*Attesting Officer*

*Commissioner of Patents and Trademarks*